US011644794B2

(12) United States Patent
Chevallier et al.

(10) Patent No.: US 11,644,794 B2
(45) Date of Patent: May 9, 2023

(54) ASSEMBLY OF GONGS FOR A STRIKING MECHANISM OF A WATCH

(71) Applicant: Blancpain SA, Le Brassus (CH)

(72) Inventors: Laurane Chevallier, Les Rousses (FR); Jérôme Favre, Neuchatel (CH); Mehdi Denden, Les Rousses (FR)

(73) Assignee: Blancpain SA, Le Brassus (CH)

( * ) Notice: Subject to any disclaimer, the term of this patent is extended or adjusted under 35 U.S.C. 154(b) by 119 days.

(21) Appl. No.: 17/101,451

(22) Filed: Nov. 23, 2020

(65) Prior Publication Data

US 2021/0173346 A1 Jun. 10, 2021

(51) Int. Cl.
*G04B 21/08* (2006.01)

(52) U.S. Cl.
CPC ..... *G04B 21/08* (2013.01)

(58) Field of Classification Search
CPC ..... G10K 1/10; G10K 1/066; G04B 21/08; G04B 23/028; G04B 21/00
See application file for complete search history.

(56) References Cited

U.S. PATENT DOCUMENTS

| | | | | |
|---|---|---|---|---|
| 7,292,505 | B2 * | 11/2007 | Schmiedchen | G04F 7/089 368/110 |
| 9,292,004 | B2 * | 3/2016 | Raggi | G04B 21/00 |
| 10,437,199 | B2 * | 10/2019 | Kadmiri | G04B 23/028 |
| 2009/0091431 | A1 | 4/2009 | Chritin et al. | |
| 2012/0063275 | A1 * | 3/2012 | Favre | G04B 23/026 368/243 |
| 2014/0104994 | A1 | 4/2014 | Raggi et al. | |
| 2016/0098981 | A1 | 4/2016 | Karapatis et al. | |

FOREIGN PATENT DOCUMENTS

| | | | |
|---|---|---|---|
| CH | 45 807 | A | 12/1909 |
| CH | 706 190 | B1 | 9/2013 |
| CN | 103728869 | A | 4/2014 |
| CN | 105093902 | A | 11/2015 |
| CN | 105489204 | A | 4/2016 |
| CN | 107132751 | A | 9/2017 |
| DE | 26 18 710 | A1 | 11/1977 |
| EP | 2 196 869 | A1 | 6/2010 |
| EP | 2 720 091 | A1 | 4/2014 |
| EP | 2 767 875 | A2 | 8/2014 |
| EP | 3 002 749 | A1 | 4/2016 |
| EP | 3 211 488 | A1 | 8/2017 |
| JP | 2014-81374 | A | 5/2014 |

(Continued)

OTHER PUBLICATIONS

Japanese Office Action dated Nov. 2, 2021 in Japanese patent Application No. 2020-196697 (with English translation), 13 pages.

(Continued)

*Primary Examiner* — Edwin A. Leon
(74) *Attorney, Agent, or Firm* — Oblon, McClelland, Maier & Neustadt, L.L.P.

(57) ABSTRACT

An assembly includes a plurality of gongs, which are connected to at least one gong carrier for a striking mechanism of a watch. Some gongs each connected to a respective gong carrier and a group of gongs connected to one and the same gong carrier are produced with materials different from each other.

14 Claims, 6 Drawing Sheets

(56) References Cited

FOREIGN PATENT DOCUMENTS

JP 2016-75895 A 5/2016

OTHER PUBLICATIONS

Combined Chinese Office Action and Search Report dated Oct. 22, 2021 in corresponding Chinese Patent Application No. 202011397591.2 (with English Translation and English Translation of Category of Cited Documents), 17 pages.
European Search Report dated May 19, 2020 in European Application 19214109.1 filed Dec 6, 2019 (with English Translation of Categories of Cited Documents & Written opinion), 7 pages.

* cited by examiner

ASSEMBLY OF GONGS FOR A STRIKING MECHANISM OF A WATCH

CROSS-REFERENCE TO RELATED APPLICATION

This application claims priority to European Patent Application No. 19214109.1 filed on Dec. 6, 2019, the entire disclosure of which is hereby incorporated herein by reference.

TECHNICAL FIELD OF THE INVENTION

The invention relates to an assembly of at least two gongs connected to at least one gong carrier for a striking mechanism of a watch. Each gong must be designed with a particular material in order to take account also of the space available in the watch case while guaranteeing generation of a rich sound when each gong is struck.

PRIOR ART

In the field of horology, a horological movement may be provided with a striking mechanism. To do this, at least one gong, which is a circular-shaped metal wire for example made from steel, may be provided. Generally, this metal wire is arranged around the movement, in the watch case. This gong is fixed, for example by soldering or brazing, to a gong carrier, which is itself secured to the main plate or middle part of the watch case. The vibration of the gong is produced by the impact, generally in proximity to the gong carrier, of at least one hammer. This vibration is composed of a plurality of natural or partial frequencies, the number and intensity of which, in particular in the audible range between 1 kHz and 20 kHz, are dependent on the geometry of the gong and the physical properties of the material used. The partials are defined in the case where the frequencies higher than the fundamental are no longer integer multiples of the lower frequency.

The gong in the form of a metal wire may also be designed in gold, as defined in the patent EP 2 107 436 B1, in order to have many partials in the audible vibration generated by the striking of the hammer. Producing a gong from gold affords great richness of the sound generated when a hammer strikes the striking mechanism. On the other hand, if a plurality of gongs made from gold are provided in the striking mechanism in order to generate different notes, there may remain problems of dissonance when the gongs are tuned or during the succession of sounds of the gongs successively struck by a hammer, which constitutes a drawback.

The patent application CH 707 078 A1 describes the addition of a different material for each gong in order to modify the sound generated. To do this, each gong is configured so as to generate a sound that is clearly determined with regard to tonal height and its frequency composition. Each gong is able to adjust the tuning between various adjacent gongs in a striking mechanism. To adjust a difference in frequency or to parameterise its vibratory behaviour, the gong may include at least one opening in the main body of its spring blade, which is filled with a material other than that of the basic spring blade of the gong. However, producing openings in each gong to be filled with another material complicates the production of each gong and the adjustment of vibration frequency thereof, which constitutes a drawback.

The patent application WO 2012/151710 A1 describes two substrikers produced with different materials, but without modification of each gong designed in the same material. Thus, this does not make it possible to eliminate any problem of dissonance when the gongs are tuned or during the succession of sounds of the gongs successively struck by a hammer of the striking mechanism, which constitutes a drawback.

SUMMARY OF THE INVENTION

The aim of the invention is therefore to overcome the drawbacks of the prior art by providing an assembly of gongs for a striking mechanism of a watch able to eliminate any problem of dissonance during tuning of the gongs or during the succession of sounds of gongs successively struck by at least one hammer of the striking mechanism.

To this end, the invention relates to an assembly of gongs comprising the features defined in the independent claim 1.

Particular embodiments of the assembly of gongs are defined in the dependent claims 2 to 17.

One advantage of the assembly of gongs lies in the fact it comprises at least two gongs connected to at least one gong carrier, and which are each produced with a different material. Each gong is configured to generate a particular note and producing these gongs or group of gongs in different materials makes it possible to avoid any dissonance in particular already when the gongs are tuned. In the case of an assembly of four gongs, two gongs of which can each be connected to their own gong carrier, whereas the other two gongs may be connected to the same gong carrier, the use of different materials makes it possible to aim at precise notes in order to obtain a melody while eliminating any dissonance in particular during tuning of the gongs.

Advantageously, each gong connected to each respective gong carrier and a group of at least two gongs connected to the same gong carrier may each be produced in a single-piece form. For example, a first gong connected to a first gong carrier is produced in one piece in single-piece form, and likewise for a second gong connected to a second gong carrier. The group of two gongs connected to the same gong carrier is also produced in one piece in single-piece form. Thus, the gong carriers can each be in the form of a plate with a thickness equivalent to each gong. They may be screwed for example to a watch movement disc or plate easily and without too much space required. They may also preferably be screwed to a rim of the middle part of the watch case in order to reduce the space requirement in the reduced space of the watch case.

BRIEF DESCRIPTION OF THE FIGURES

The aims, advantages and features of an assembly of gongs for a striking mechanism of a watch will appear more clearly in the following description, in particular with regard to the drawings, on which.

DETAILED DESCRIPTION OF THE INVENTION

In the following description, all the parts of a striking mechanism of a watch, which comprises an assembly of gongs connected to at least one gong carrier, which are well known in this technical field, are described only summarily. Emphasis is placed mainly on the assembly of gongs for the striking mechanism in the watch case with its particularities of arrangement and design.

Figure 1:
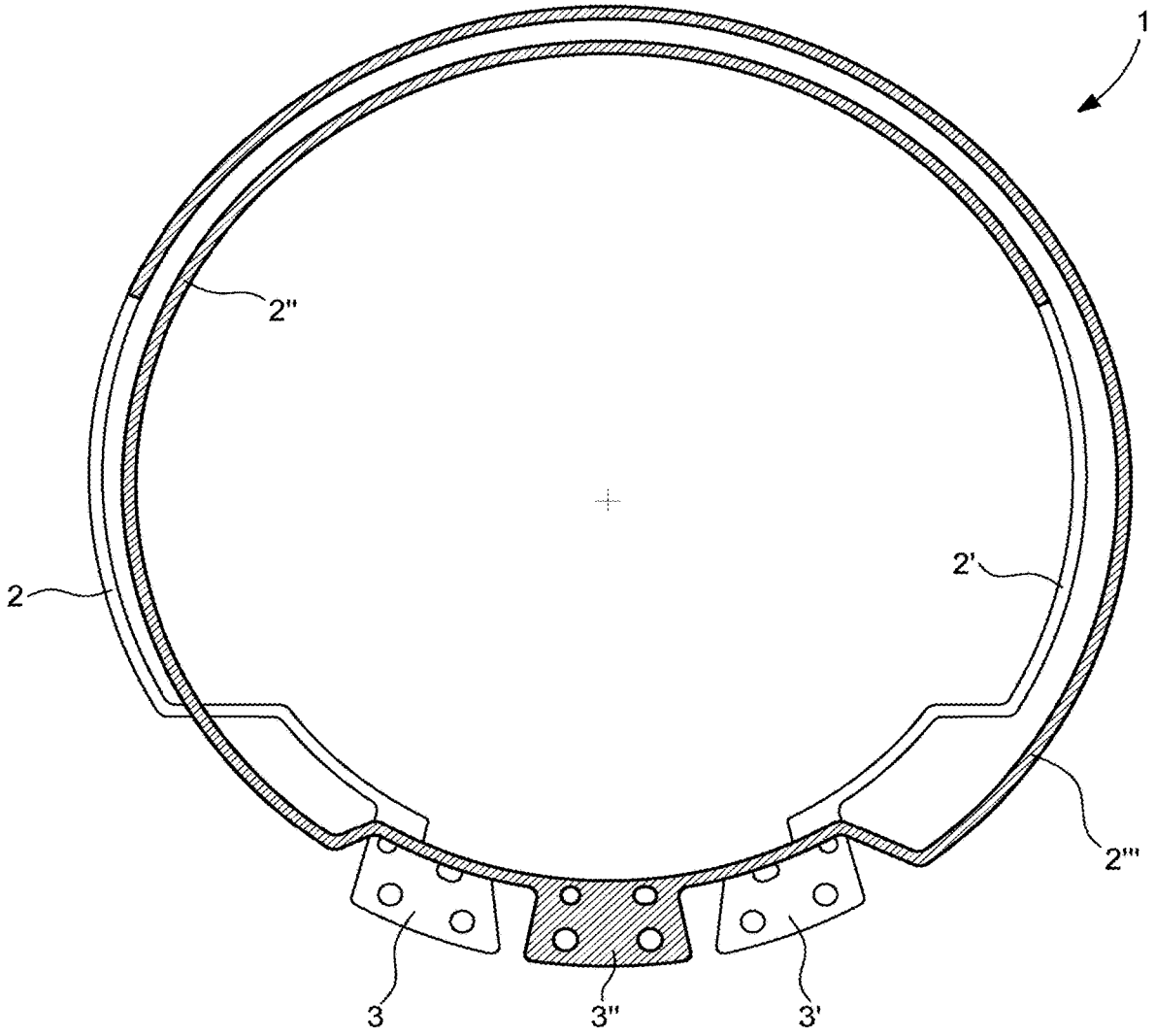
FIG. 1 shows a top view of an assembly of gongs for a striking mechanism of a watch according to the invention.

FIG. 1 shows an assembly 1 of gongs, which comprises at least two gongs 2, 2', which can be connected to at least one gong carrier 3 or each to their own gong carrier 3, 3' as shown partly in FIG. 1. The two gongs 2, 2' are produced with materials different from each other. The assembly 1 of gongs may also comprise more than two gongs 2, 2', 2", 2'", which may be connected to the same gong carrier 3 in a simplified embodiment and, in this case, each gong 2, 2', 2", 2'" may be produced from a material different from each other gong 2, 2', 2", 2'". The gong carrier 3, to which a first end of each gong 2, 2', 2", 2'" can be connected, whereas each second end of the gongs 2, 2', 2", 2'" can be free to move and can be fixed to a main plate of a horological movement of the watch with striking, or even to a rim or a wall of the middle part of the watch case, and underneath a watch dial. According to a particular embodiment, the gongs, generally circular in shape, may be disposed partly around the horological movement.

As shown in more detail in FIG. 1, the assembly 1 of gongs comprises four gongs 2, 2', 2", 2'". A first gong 2 is connected to a first gong carrier 3, and is produced in a first material. A second gong 2' is connected to a second gong carrier 3', and is produced from a second material different from the first material. A third gong 2" and a fourth gong 2' are connected to the same third gong carrier 3", and are produced from a third material different from the first material and the second material. However, it may be envisaged having at least two different materials for producing the four gongs.

A first end of the first gong 2 is connected to the first gong carrier 3, whereas a second end of the first gong 2 is free to move. A first end of the second gong 2' is connected to the second gong carrier 3', whereas a second end of the second gong 2' is free to move. A first end of the third gong 2" is connected to a first end of the third gong carrier 3", whereas a first end of the fourth gong 2'" is connected to a second side of the third gong carrier 3" opposite to the first side. A second end of the third gong 2" and a second end of the fourth gong 2'" are free to move.

Each gong carrier 3, 3', 3" shown in FIG. 1 is in the form of a plate, but other forms of gong carrier can be envisaged. The thickness of each plate is similar to the thickness of each gong 2, 2', 2", 2'". Each gong is in a circular shape with a diameter corresponding to the diameter of the watch glass, while describing a portion of a circle with an angle which may be between 150° and 250°, preferably between 185° and 220°. Each gong can be designed so as to surround part of the horological movement, not shown. The gong carriers 3, 3', 3" are designed with certain openings for attaching for example to a disc or a main plate supporting the horological movement or preferably to a rim or a wall of the middle part of the watch case. The third gong carrier 3" may be arranged and fixed in the same plane as the first 3 and second 3' gong carriers on the rim of the middle part for example and between the first 3 and second 3' gong carriers. The three gong carriers 3, 3', 3" are arranged in a circular manner, for example in line with all the circular-shaped gongs 2, 2', 2", 2'". However, provision may also be made to fix the gong carriers to the movement disc.

The first gong 2 and the first gong carrier 3 may also form only one piece in single-piece form produced with the same material. Thus the plate forming a gong carrier 3 comprises piercings for attaching, for example by means of screws, the gong 2 to a corresponding part of a middle part of the watch case or of a disc of the horological movement. The gong carrier may also be in another form and with a different thickness or be made in one piece with a portion of the watch middle. The second gong 2' and the second gong carrier 3' may also form only one piece in single-piece form produced with the same material different from the material of the gong 2 and the first gong carrier 3. The third gong 2" and the fourth gong 2'" connected to the third gong carrier 3" may also form only one piece in single-piece form produced with the same material, which is different from the material of the first gong 2 with the first gong carrier 3 and from the second gong 2' with the second gong carrier 3', However, it may be envisaged having two different materials for producing the four gongs.

Each gong 2, 2', 2", 2'" connected to its respective gong carrier 3, 3', 3" in order to be mounted in the watch case generally forms part of a striking mechanism, which also preferably comprises one hammer per gong in order to strike the respective gong at predetermined instants. An impact portion of each hammer, not shown in FIG. 1, generally strikes the corresponding gong in proximity to the connection thereof to the gong carrier thereof in order to generate an acoustic resonance. With four gongs provided, the striking mechanism comprises four hammers mounted rotatably on the disc in order to strike each corresponding gong at predefined instants in order to generate a melody of a chime, for example the Westminster chimes.

Figure 2A:
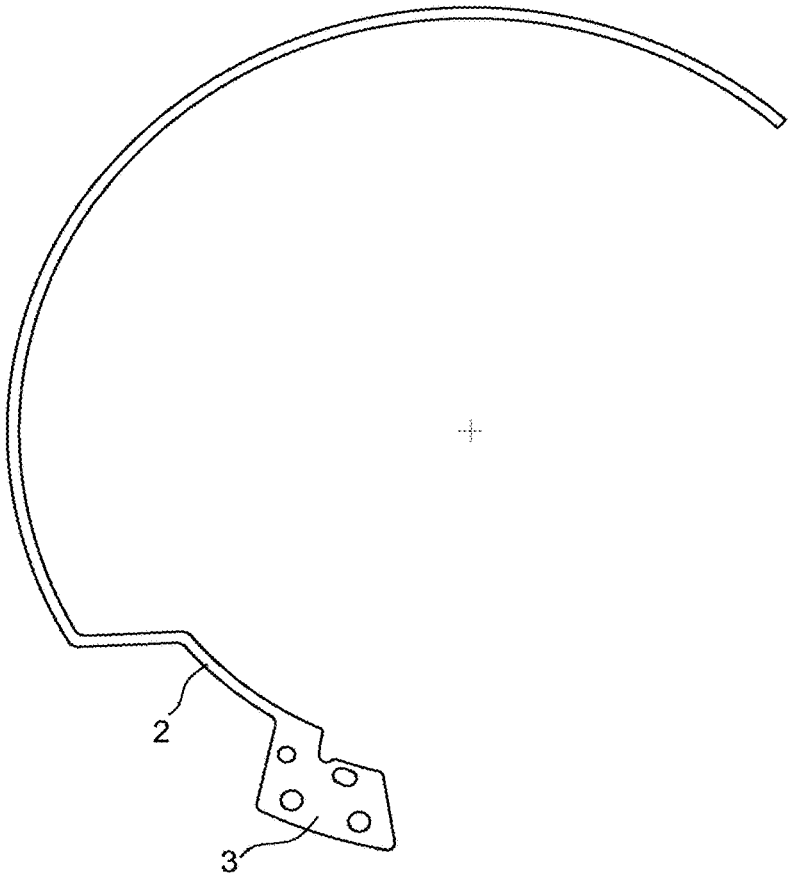
FIGS. 2*a* to 2*c* show a top view of each of the gongs connected to the gong carrier thereof in the assembly of gongs in FIG. 1 according to the invention.
Figure 2B:
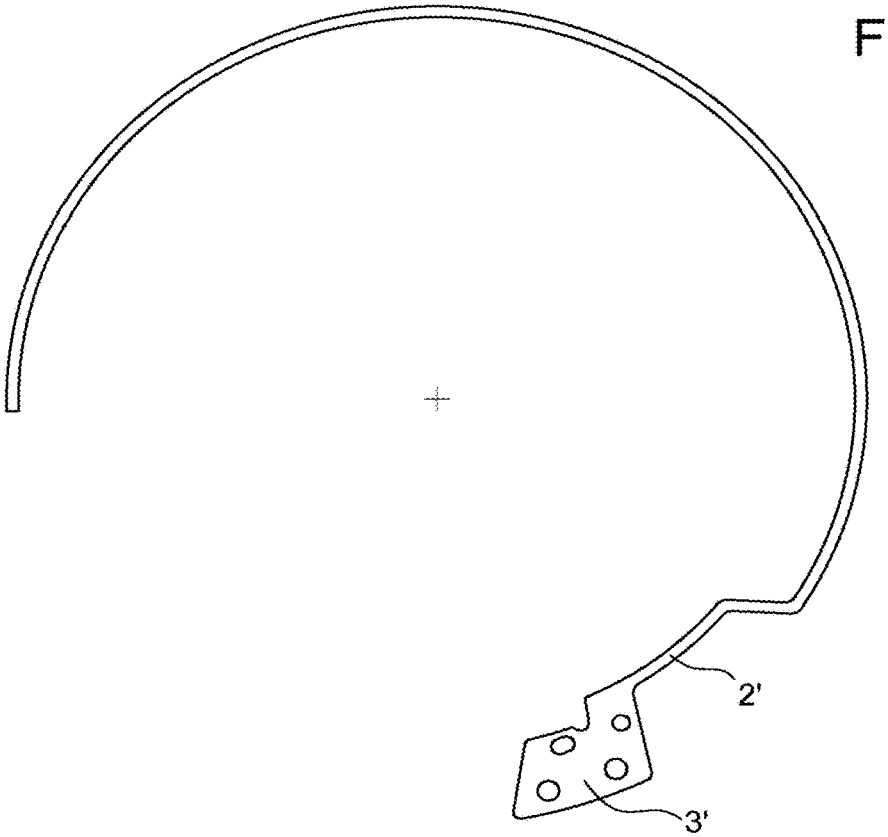
Figure 2C:
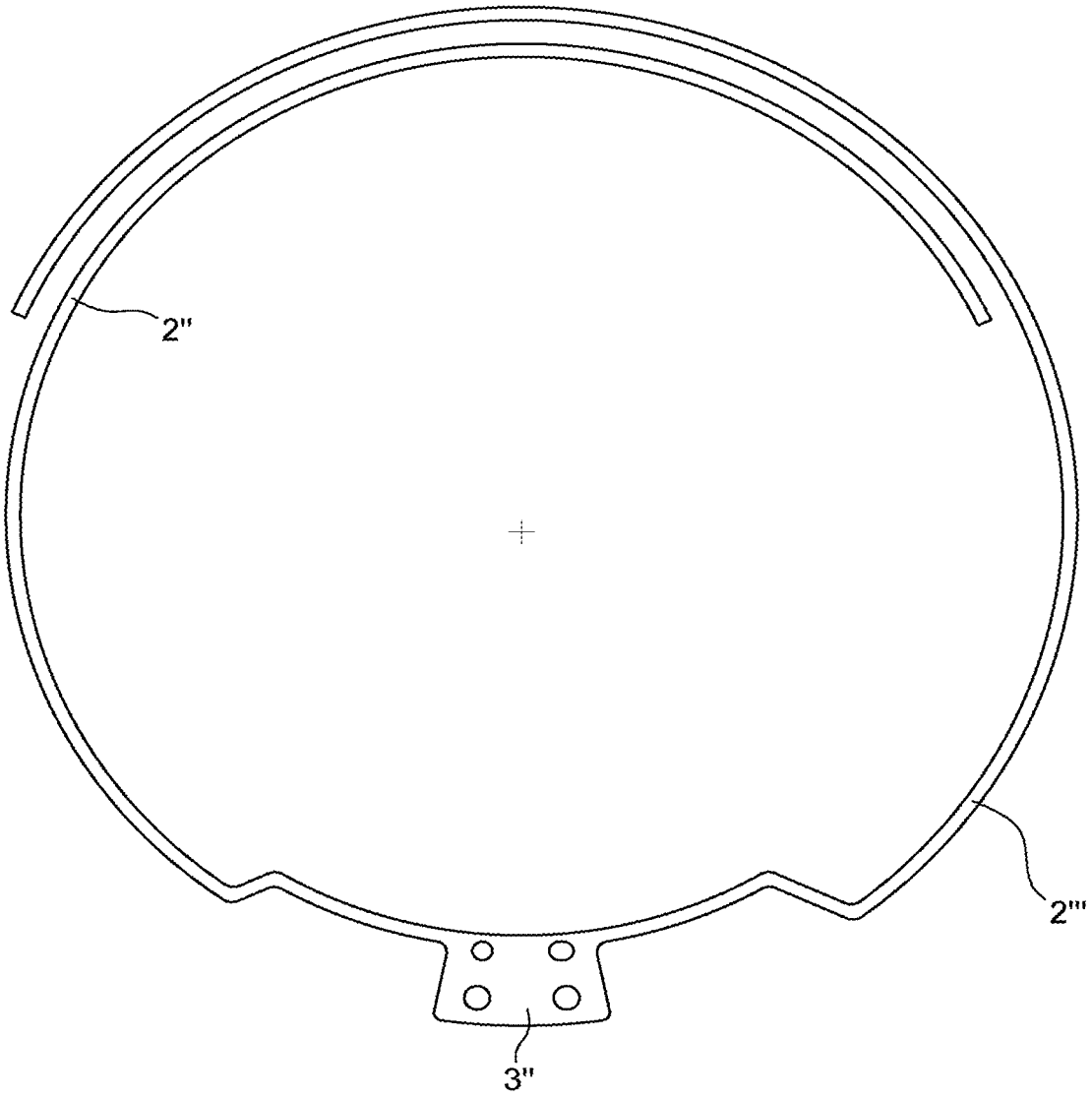

FIGS. 2*a* to 2*c* show the four gongs configured and tuned so as to generate a specific melody. The first gong 2 having a thickness of less than 1 mm and connected to the first gong carrier 3 is produced with a first material and configured so as to surround part of the watch movement in order to generate a first note. The second gong 2', which may have an equivalent thickness to the first gong 2, and connected to the second gong carrier 3', is produced with a second material and configured to surround part of the watch movement in order to generate a second note different from the first note. The third gong 2", which may have an equivalent thickness to the first gong 2, and connected to the third gong carrier 3", is produced with a third material and configured to surround part of the watch movement in order to generate a third note different from the first note and from the second note. The fourth gong 2'", which may have a thickness equivalent to the first gong 2, and connected to the third gong carrier 3", is produced with the third material and configured to surround part of the watch movement in order to generate a fourth note different from the first note, from the second note and from the third note.

As precisely specified according to the invention, at least two different materials are to be provided for producing the gongs and for being able to eliminate any problem of dissonance when tuning the gongs or during succession of sounds of gongs successively struck by a respective hammer of the striking mechanism.

The materials to be used for the present invention for each gong partly differently from each other can be chosen from the materials such as:

a copper and bronze based alloy, a metallic glass based on palladium or copper or zirconium or platinum or the like, an alloy based on cobalt, a steel with a percentage of iron greater than or equal to 60% by mass and containing at least one element such as Cr, Ni, Mn, Al, Si, C, Mo, V, such as quench-hardened steels or spring steels for example, a silver, gold, palladium or platinum alloy, a tungsten-based alloy.

Each gong 2, 2', 2", 2''' with its gong carrier 3, 3', 3" may be produced by milling, electroerosion, laser machining, moulding, casting, hot pressing or another suitable manufacturing method in this technical field. The gong or gongs 2, 2', 2", 2''' may also come from cast products or hot-pressed products, or hot or cold deformed products. This means that the gongs 2, 2', 2", 2''' may be anisotropic or isotropic. These characteristics may have an influence on the acoustic properties.

Figure 3:
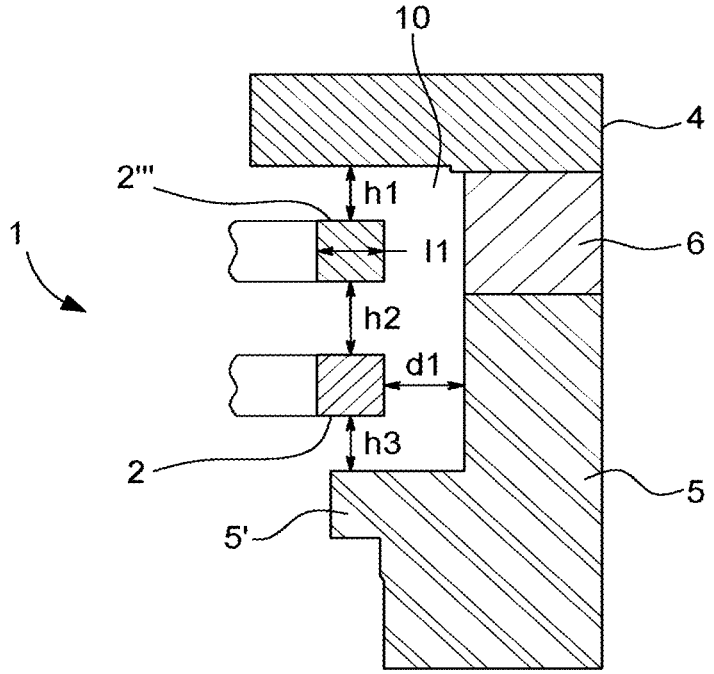
FIG. 3 shows a view in partial cross-section of a part of a watch with striking having an assembly with two gongs according to the invention.

FIG. 3 shows a view in partial cross-section of a part of a watch with striking, which comprises at least two gongs 2, 2''' for a minute repetition according to the invention. The circular-shaped first gong 2 for example is arranged below the circular shaped second gong 2''' for example, but with a different length in order to generate a note other than the first note once activated. The first gong 2 is produced from a first material different from the second material of the second gong 2'''.

The second gong 2''' may be situated just below a watch dial 4, whereas the first gong 2 is below the second gong 2''' and above an internal rim 5' of the watch middle 5. A joint portion 6 connects the dial to the middle part 5. A small space 10 for placing the gongs 2, 2''' is provided. The gong carriers, not shown, may be fixed to the internal rim 5' if they form a plate with the same thickness as each gong.

Each gong 2, 2''' has a width 11 equal to or greater than 0.4 mm. The second gong 2''' is spaced apart from the dial 4 by height h1 with approximately the same value as its cross-section. The first gong 2 is spaced apart by a height h2 by a value less than twice its cross-section from the second gong 2'''. Finally, the first gong 2 is spaced apart by a height h3 of approximately the value of its cross-section from the bottom internal rim 5' of the middle part 5. The first and second gongs 2, 2''' are spaced apart from the middle part 5 by a distance di equal to or less than twice the value of their cross-section.

Figure 4:
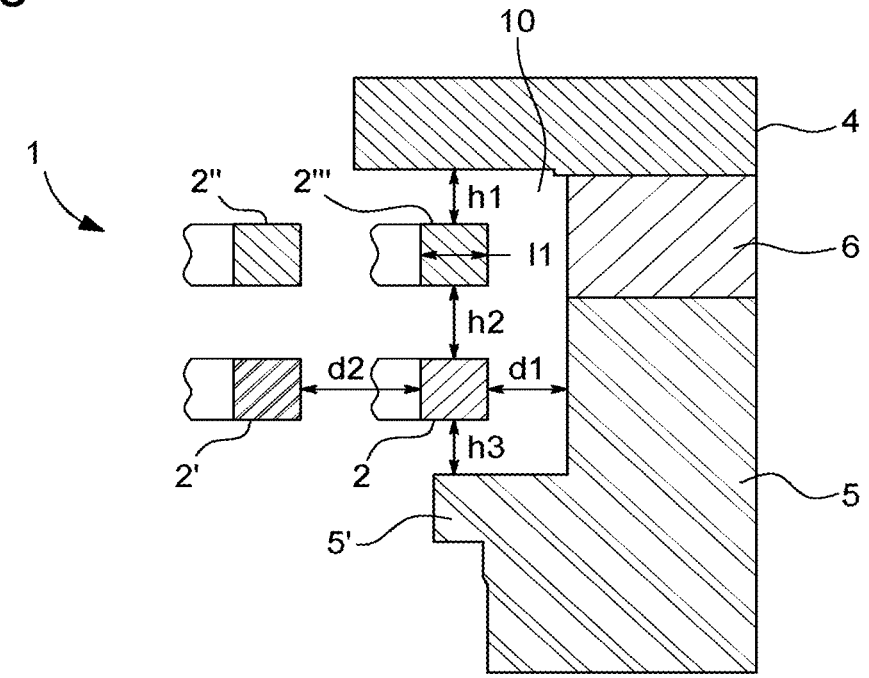
FIG. 4 shows a view in partial cross-section of a part of a watch with striking having an assembly with four gongs according to the invention.

FIG. 4 shows a view in partial cross-section of a part of a watch with striking, which comprises four gongs 2, 2', 2", 2''' for example for a melody or a chime according to the invention. A second gong 2' is mounted coaxial towards the inside and in the same plane as the first gong 2. A third gong 2" is mounted coaxial towards the inside and in the same plane as a fourth gong 2'''. The third gong 2" and fourth gong 2''' are mounted above the second gong 2' and above the first gong 2 just below the watch dial 4. Each gong has a different length and/or a different shape or thickness so as to each generate a particular different note once activated. The space between the first and fourth gongs 2, 2" and between the second and third gongs 2', 2" is approximately the cross-section thereof.

It should be noted that an assembly of four gongs can also be provided, where each gong is connected to its own gong carrier and where each gong is produced from a material different from each other gong. In addition, it can also be envisaged that each gong connected to its own gong carrier forms only one piece in single-piece form.

The theory of acoustics and the phenomenon of dissonance are explained in order to give a good understanding of the present invention with the production of the gongs from different materials.

There exists a semitone between each successive note making up a scale. The interval between two notes can be qualified according to the number of semitones that there are between the two notes. For example a difference of one semitone between two notes is called a minor second, for example between do and do # or between mi and fa. A difference of seven semitones between two notes is called a perfect fifth. Some intervals are pleasant to hear, and it will be said that they are consonant. Other intervals are not pleasant to hear, and it will be said that they are dissonant.

Intervals are normally classified from the most consonant to the most dissonant in the following order unison, octave, perfect fifth, perfect fourth, major third, major sixth, minor third, minor sixth, minor seventh, major second, tritone, major seventh, and then minor second.

A note corresponds to a fundamental frequency that can be determined by the following formula:

$$fn = f0x2^{\frac{n}{12}}$$

fn: Frequency of the required note, f0: Frequency of the reference note (La3 at 440 Hz in the tempered scale), n: Semitone above the note.

This gives the following frequencies in Hertz according to the various octaves:

| | 0 | 1 | 2 | 3 | 4 | 5 | 6 | 7 | 8 | 9 |
|---|---|---|---|---|---|---|---|---|---|---|
| do | 32.703 | 65.406 | 130.81 | 261.63 | 523.25 | 1046.5 | 2093. | 4186. | 8372. | 16744. |
| do# | 34.648 | 69.296 | 138.59 | 277.18 | 554.37 | 1108.7 | 2217.5 | 4434.9 | 8869.8 | 17740. |
| ré | 36.708 | 73.416 | 146.83 | 293.66 | 587.33 | 1174.7 | 2349.3 | 4698.6 | 9397.3 | 18795. |
| ré# | 38.891 | 77.782 | 155.56 | 311.13 | 622.25 | 1244.5 | 2489. | 4978. | 9956.1 | 19912. |
| mí | 41.203 | 82.407 | 164.81 | 329.63 | 659.26 | 1318.5 | 2637. | 5274. | 10548. | 21096. |
| fa | 43.654 | 87.307 | 174.61 | 349.23 | 698.46 | 1396.9 | 2793.8 | 5587.7 | 11175. | 22351. |
| fa# | 46.249 | 92.499 | 185. | 369.99 | 739.99 | 1480. | 2960. | 5919.9 | 11840. | 23680. |
| sol | 48.999 | 97.999 | 196. | 392. | 783.99 | 1568. | 3136. | 6271.9 | 12544. | 25088. |
| sol# | 51.913 | 103.83 | 297.65 | 415.3 | 830.61 | 1661.2 | 3322.4 | 6644.9 | 13290. | 26580. |
| la | 55. | 110. | 220. | 440. | 880. | 1760. | 3520. | 7040. | 14080. | 28160. |
| la# | 58.27 | 116.54 | 233.08 | 466.16 | 932.33 | 1864.7 | 3729.3 | 7458.6 | 14917. | 29834. |
| si | 61.735 | 123.47 | 246.94 | 493.88 | 987.77 | 1975.5 | 3951.1 | 7902.1 | 15804. | 31609. |

An example of use of the mixing method is given below.

For a watch with chimes, the search for precise notes is necessary in order to construct a melody that is pleasant to the ear. The method for tuning a gong consists of aiming at a note at a given frequency and the other partials obtained are dependent on the frequency aimed at. For example, for tuning the gong made from 5N gold to the note Si, the length of the gong is adjusted in order best to approximate the frequency of 1975.5 Hz aimed at. Other frequencies are also generated during striking. These frequency modes are different for example according in particular to the geometry and the material of the gong.

The succession of two consecutive notes may lead to dissonances if the various partials are not in tune. For example, it is well known that a minor second, that is to say one semitone between two notes, is very dissonant. A difference of a semitone is found for example between the note "La" and the note "La #" or between the note "Si" and the note "Do". This means that two notes separated by a semitone played at the same time or successively would appear dissonant to the ear.

Next, a rich sound is characterised by numerous modes in the range of audible frequencies whereas a poor sound will have fewer frequency modes in the audible frequency range and will appear more crystalline. A rich sound can therefore be very pleasant to the ear, but there will be greater chances of having dissonances, if several notes with a rich sound are played successively. The material mixing method will make it possible to avoid this type of dissonance.

Figure 5A:
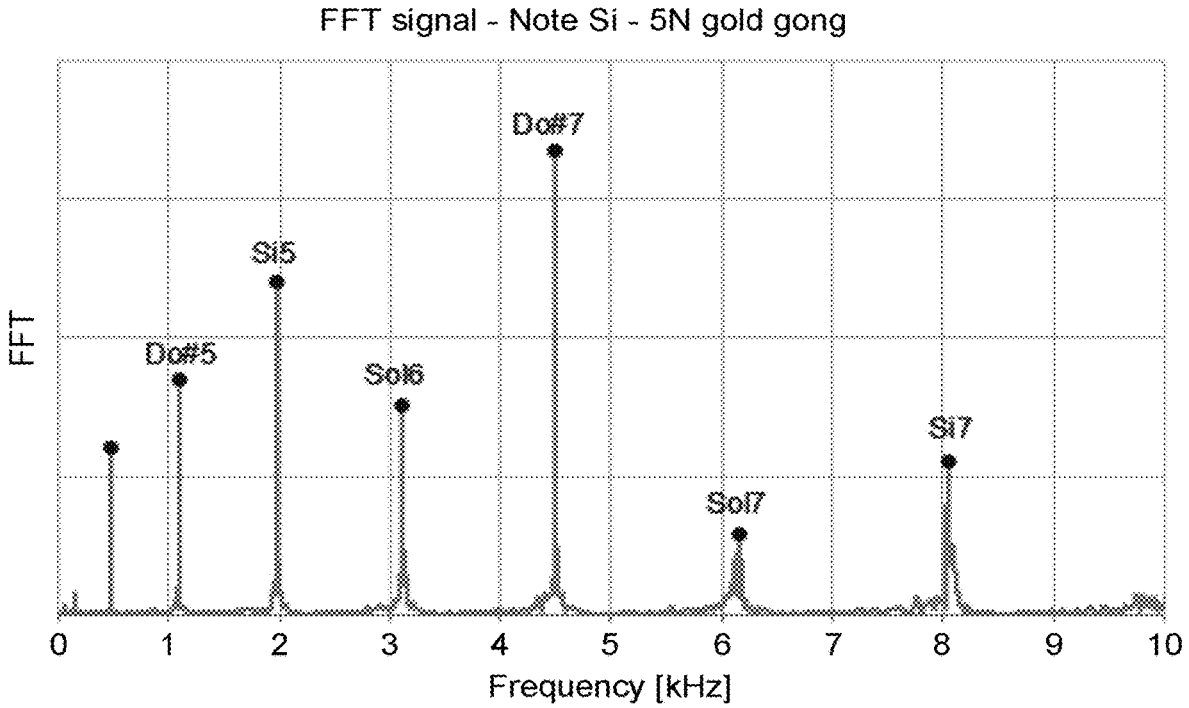
FIG. 5*a* to 5*c* show various spectra of notes to be played of an assembly of gongs according to the invention.
Figure 5B:
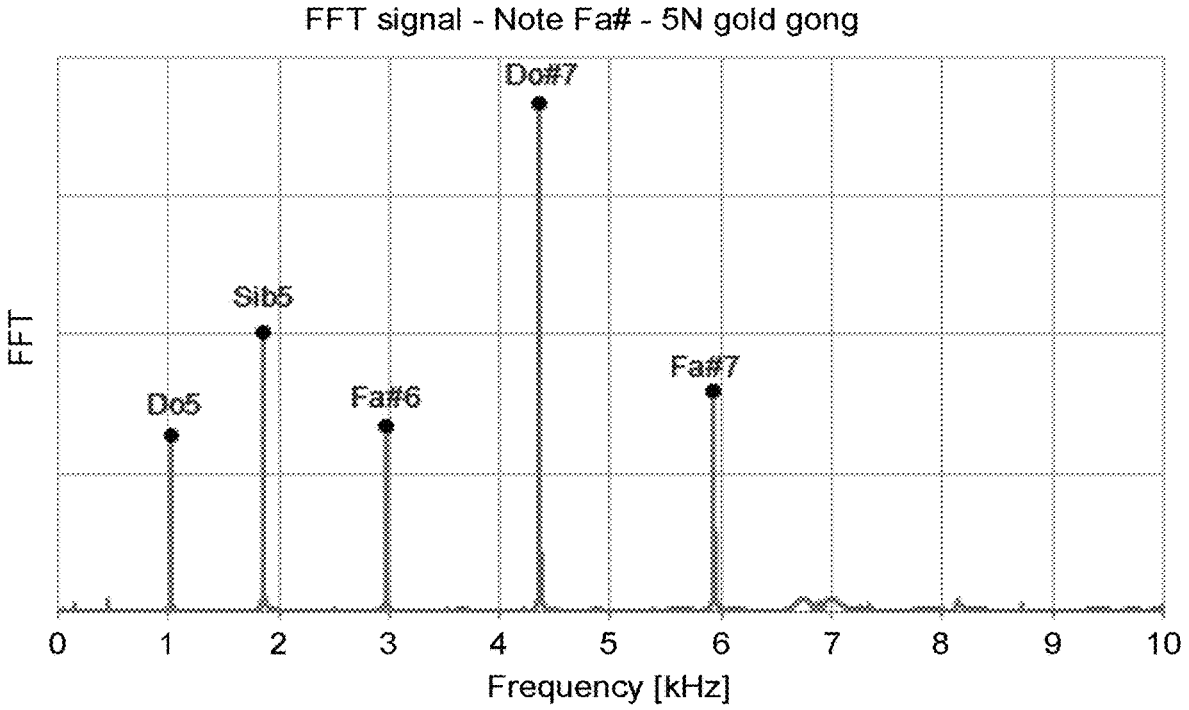
Figure 5C:
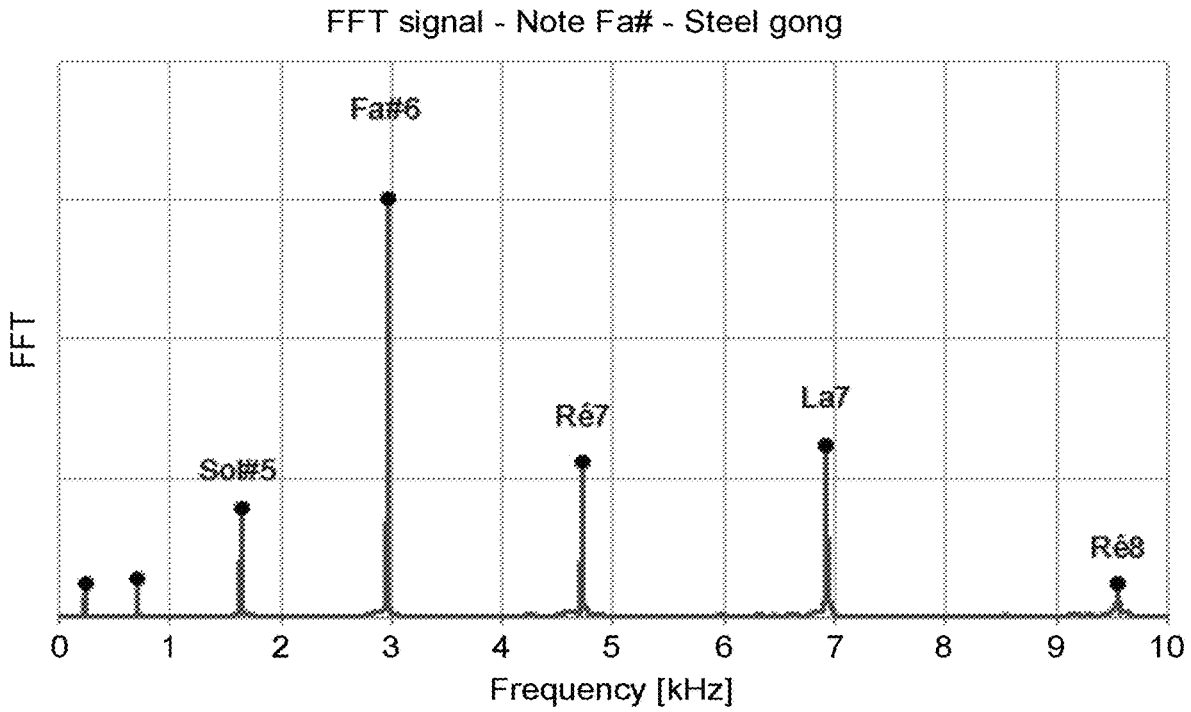

For example, a material such as gold, which is known for generating rich sounds, can be taken. A gong, as defined below, made from 5N gold tuned to generate the note Si at 1975.5 Hz may for example have a spectrum shown in FIG. 5*a*. The height of the peaks is not representative. A gong, as defined, made from 5N gold tuned to generate the note Fa # at 2960 Hz may for example have a spectrum as shown in FIG. 5*b*. The height of the peaks is not representative. A gong, as defined below, made from steel tuned to generate the note Fa # at 2960 Hz may for example have a spectrum as shown in FIG. 5*c*. The height of the peaks is not representative.

If the frequency modes that are interesting for constructing a melody between 1000 Hz and 10000 Hz are considered, it will be noted that, for the succession for example of the notes Si and Fa made from 5N gold, there are four modes that are dissonant. In a melody, a slight damping of the notes may be sought. In this case, successively generating notes Si and Fa on two gongs made from 5N gold will be able to generate four minor seconds (cf. table below), which is dissonant.

| | Mode 1 | Mode 2 | Mode 3 | Mode 4 | Mode 5 | Mode 6 |
|---|---|---|---|---|---|---|
| 5 N gold gong tuned to the note Si | Do#5 | Si5 | Sol6 | Do#7 | Sol7 | Si7 |
| 5 N gold gong tuned to the note Fa# | Do5 | Sib5 | Fa#6 | Do#7 | Fa#7 | — |
| Number of semitones | 1 | 1 | 1 | 0 | 1 | — |
| Interval | Minor second | Minor second | Minor second | Unison | Minor second | — |
| Musical assessment | Dissonance | Dissonance | Dissonance | Absolute consonance | Dissonance | — |

In this case for example, a steel gong could therefore be used to play successively the note Si on a gold gong and Fa on a steel gong. This would then give the following tunings:

| | Mode 1 | Mode 2 | Mode 3 | Mode 4 | Mode 5 | Mode 6 |
|---|---|---|---|---|---|---|
| 5 N gold gong tuned to the note Si | Do#5 | Si5 | Sol6 | Do#7 | Sol7 | Si7 |
| 5 N gold gong tuned to the note Fa# | Sol#5 | Fa#6 | Re7 | La7 | Re8 | — |
| Number of semitones | 7 | 7 | 7 | 8 | 7 | — |
| Interval | Perfect fifth | Perfect fifth | Perfect fifth | Minor sixth | Perfect fifth | — |
| Musical assessment | Consonance | Consonance | Consonance | Consonance | Consonance | — |

Thus, in this example, if two notes are played successively, Si and Fa #, the mixing of materials of the two gongs made from 5N gold and steel makes it possible to avoid the dissonances that are generated with two gold gongs.

This example gives a concrete vision of the use of this mixing method but is not limited to this. The acoustic analysis and the perception of the human ear will be preponderant with regard to the detection of dissonance.

This is because, in the above example, some frequencies leading to dissonances are not heard by the ear. In other words, it is mainly the human ear that will detect these dissonances, which will be able to be avoided by means of a mixing of the gong materials.

In addition to the mixing of material, it can be envisaged also mixing the size of the gongs in order also to avoid dissonance phenomena. For example, it is possible to act on the shape and size of the cross-sections of the gongs. It is possible to assemble a gong with a round cross-section and a gong with a square cross-section. It is also possible to have a gong with a round cross-section and a gong with a square cross-section connected to the same gong carrier or two different gong carriers. It is also possible to assemble a gong with a round cross-section with a gong with a round cross-section with a different diameter, or to have gongs with a round cross-section connected to the same gong carrier or two different gong carriers. It is also possible to assemble a gong with a square cross-section with a first surface area, for example 0.5 mm×0.5 mm, with a gong with a square cross-section with a second surface area, for example 0.65 mm×0.65 mm. It is again possible to have a gong with a square cross-section with the first surface area, for example 0.5 mm×0.5 mm, and a gong with a square cross-section with the second surface area, for example 0.65 mm×0.65 mm, connected to the same gong carrier or to two different gong carriers.

Naturally other dimensional values for the gongs can be applied according to the size of the watch equipped with the striking mechanism.

From the description that has just been made, several variants of the assembly of gongs for a striking mechanism of a watch can be designed by a person skilled in the art without departing from the scope of the invention defined by the claims.

The invention claimed is:

1. An assembly of at least two gongs connected to at least one gong carrier for a striking mechanism of a watch, the assembly comprising:

at least one first gong and a second gong, wherein the at least one first gong is connected to a first gong carrier, the second gong is connected to a second gong carrier, and the first gong is made of a material that is different from a material of the second gong, and a third gong and a fourth gong connected to opposite sides of a third gong carrier, wherein the third gong and a fourth gong are made of respective materials that are different from each other and different from the materials of the first and second gongs, and each of the first gong, second gong, third gong, and fourth gong, is in a circular shape.

2. The assembly according to claim 1, wherein each of the first gong and the second gong connected to the respective first and second gong carriers is produced in one piece in single-piece form.

3. The assembly according to claim 1, wherein the third gong is connected by one end to a first side of the same third gong carrier, whereas the fourth gong is connected by one end to a second side of the same third gong carrier opposite to the first side.

4. The assembly according to claim 3, wherein the third gong and the fourth gong connected to the same third gong carrier are produced in only one piece in single-piece form, and the first and second gongs connected to the respective first and second gone carriers are each produced in only one piece in single-piece form.

5. The assembly according to claim 4, wherein each gong carrier is in a form of a plate with a thickness similar to a thickness of each gong.

6. The assembly according to claim 1, further comprising the first-fourth gongs are connected to the first-third gong carriers by a respective first end, wherein a second end of each gong is free to move.

7. The assembly according to claim 6, wherein each gong carrier connected to one or two gongs is produced in one piece in single-piece form.

8. The assembly according to claim 1, wherein the first and second gongs are each separated laterally from a watch case by a distance equal to or less than twice a thickness of their respective cross sections.

9. The assembly according to claim 1, wherein at least the two gongs are configured to be arranged one above the other in a watch case and having different lengths so as each to generate a particular different note once activated for a minutes repetition.

10. The assembly according to claim 1, wherein the four gongs have different lengths so as each to generate a particular different note once activated for a chime, wherein the first gong and the fourth gong are arranged one above the other in a watch case, the second gong and the third gong are able to be arranged one above the other in the watch case, the second gong is to be mounted coaxial towards the inside and in the same plane as the first gong, and the third gong is intended to be mounted coaxial towards the inside and in the same plane as the fourth gong.

11. The assembly according to claim 1, wherein the materials for each gong are selected from a tungsten alloy, an alloy based on copper and bronze, a metallic glass based on palladium or copper or zirconium or platinum, an alloy based on cobalt, a steel with a percentage of iron greater than 60% by mass and containing elements including Cr, Ni, Mn, Al, Si, C, Mo or V.

12. The assembly according to claim 1, wherein one gong of the first gong and the second gong with a round cross-section is connected to another gong of the first gong and the second gong with a square cross-section.

13. The assembly according to claim 1, wherein one gong of the first gong and the second gong with a round cross-section is connected to another gong of the first gong and the second gong with a round cross-section of a different diameter.

14. The assembly according to claim 1, wherein one gong of the first gong and the second gong with a square cross-section with a first surface area is connected to another gong of the first gong and the second gong with a square cross-section with a second surface area different from the first surface area.

* * * * *